US010287124B2

(12) United States Patent
Milosavljevic

(10) Patent No.: US 10,287,124 B2
(45) Date of Patent: May 14, 2019

(54) AIRFOIL WITH PERPENDICULAR AIRFLOW

(71) Applicant: ANDRITZ AG, Graz (AT)

(72) Inventor: Nenad Milosavljevic, Graz (AT)

(73) Assignee: ANDRITZ AG, Graz (AT)

( * ) Notice: Subject to any disclaimer, the term of this patent is extended or adjusted under 35 U.S.C. 154(b) by 0 days.

(21) Appl. No.: 15/554,838

(22) PCT Filed: Mar. 11, 2016

(86) PCT No.: PCT/EP2016/055255

§ 371 (c)(1),
(2) Date: Aug. 31, 2017

(87) PCT Pub. No.: WO2016/142509

PCT Pub. Date: Sep. 15, 2016

(65) Prior Publication Data

US 2018/0037430 A1 Feb. 8, 2018

Related U.S. Application Data

(60) Provisional application No. 62/131,399, filed on Mar. 11, 2015.

(51) Int. Cl.

| | |
|---|---|
| ***D21F 11/14*** | (2006.01) |
| ***B65H 23/24*** | (2006.01) |
| ***D21G 9/00*** | (2006.01) |

(52) U.S. Cl.

CPC ..... *B65H 23/24* (2013.01); *D21F 11/14* (2013.01); *D21G 9/0063* (2013.01); *B65H 2801/84* (2013.01)

(58) Field of Classification Search

USPC ..... 162/270

See application file for complete search history.

(56) References Cited

U.S. PATENT DOCUMENTS

| | | | |
|---|---|---|---|
| 4,698,919 | A | 10/1987 | Wedel |
| 5,438,765 | A | 8/1995 | Tyrmi et al. |
| 6,325,896 | B1 | 12/2001 | Hultcrantz et al. |

FOREIGN PATENT DOCUMENTS

| | | | |
|---|---|---|---|
| EP | 2273007 | A2 | 1/2011 |
| WO | 2009127054 | A1 | 10/2009 |

OTHER PUBLICATIONS

International Search Report and Written Opinion dated May 20, 2016 (PCT/EP2016/055255).

International Preliminary Report on Patentability dated Mar. 24, 2017 (PCT/EP2016/055255).

*Primary Examiner* — Mark Halpern

(74) *Attorney, Agent, or Firm* — Alix, Yale & Ristas, LLP

(57) ABSTRACT

The problem of web flutter experienced by webs spanning the draw between a drying area of a fiber web manufacturing machine and winder, wherein the web is assisted by airfoils is mitigated by using at least one airfoil having multiple conduits connected to at least one air supply, at least two areas with openings in form of slots or rows of holes (or elongated openings) are oriented a direction substantially parallel to the direction of web movement, wherein the openings communicate with the multiple conduits, a Coanda surface disposed adjacent to the openings, and wherein the openings are configured to direct air flowing from the air source through the multiple conduits, through the openings over the Coanda surface in a direction substantially perpendicular to the direction of web movement.

20 Claims, 10 Drawing Sheets

AIRFOIL WITH PERPENDICULAR AIRFLOW

RELATED APPLICATION

This application is a U.S. National Stage entry of International Patent Application No. PCT/EP2016/055255, filed Mar. 11, 2016, which claims the benefit of U.S. provisional patent application No. 62/131,399, filed on Mar. 11, 2015, the entirety of which is incorporated herein by reference.

BACKGROUND OF THE INVENTION

Technical Field

The present disclosure relates generally to airfoils and particularly to active airfoils used to convey sheets of fibrous material through a draw between production areas.

Related Art

In the manufacture a continuous web of tissue paper or light-weight non-woven fibrous material, a space, commonly known as a draw generally separates the production line's drying area from the production line's winding area. In the case of paper manufacturing, the drying area may have a Yankee cylinder dryer, and the winding area may have one or more spools around which the tissue is wound into rolls. The rolls may be stored in inventory or moved for further processing. The draw is generally long enough to separate the winder from the drying area of the production machine, while allowing equipment to perform intermediate operations on the web as the web travels from the drying area and winding area.

These intermediate operations may include by way of example: calendaring (e.g. passing two or more webs through adjacently disposed rollers to produce webs of uniform thickness), caliper control (e.g. the measurement and adjustment of web unit weight and moisture), quality control (e.g. the real time scanning of web to identify holes and inconsistent fiber distribution), slitting (e.g. cutting the width of web exiting the dryer into multiple narrower widths), and re-pulping that portion of the web which is not being wound, such as the initial web output at production start-up or at a web break.

The web exiting the dryer section of the production machine is generally quite fragile and encounters destabilizing problems as the web moves through some of these intermediate operations. The web generally entrains a layer of air as the web moves through the draw. As the entrained air encounters the equipment that comprises the intermediate operations, the entrained air may become turbulent and create web fluttering. Fluttering can tear the web and generate dust, thereby diminishing the quality of web. While some of the intermediate operations may contribute to stabilizing the web; others can have a net destabilizing effect on the web's position and steadiness.

To account for sections of web instability along the draw, operators have tried to control the web as the web passes from the machine dryer section to the winder. These control devices included bowed pipes or rolls, straight pipes or rolls, and large flat plates or other similar devices. The nature of tissue is such that tissue has a surface being comprised to a multitude of pulp fibers radiating outwardly. As these fibers contact with stationary rigid devices such as rolls or pipes, the rigid devices tend to break these fibers, which results in the production of an extremely fine paper dust. This paper dust presents both a fire hazard situation, as well as a health hazard for the operators through ingestion into the lungs.

Previously, a common method for changing the web path through the tissue manufacturing process involved a rigid pipe. Whether bowed or straight a rigid pipe is generally simple to manufacture and install. However, the pipe method has several inherent problems. The web is generally in firm contact with the pipe, thus requiring additional tension to be applied to the web. Secondly, paper is abrasive, and gradually wears away at the pipe, encouraging periodic replacement. Thirdly, a web has a general tendency to remain attached to the curved surface of the pipe, thus requiring additional tension to break the web loose. Typically, dust particles will collect near the breakaway point, forming an extension of the pipe which eventually breaks off, falling onto the web and either contaminating the web or breaking the web.

Large flat plates were another previously popular web stabilizer and web transport system. Since this large flat plate generally occupies the majority of the draw between the dryer cylinder and the next machine element, the large flat plate is generally moved at time of start-up or web break to provide an unobstructed path for the web traverse to the re-pulper system broke pit. A mechanically driven member generally facilitates plate movement, which adds to the total system complexity. The large flat plate's long machine direction length is such that the web can alternately collapse against the surface of the plate, then pick up from the plate and subsequently collapse again, resulting in the generation of dust due to physical contact, which in turn adds to the total web tension. Additionally, to provide sufficient structural rigidity, the plate is generally made with some finite thickness to accommodate the inclusion of internal structural re-enforcement. As a result of this thickness, the entry and exit ends are shaped (generally rounded) to facilitate smooth entry and exit. The behavior of these curved ends is similar to that of the rigid pipe design, except that the tendency for web attachment to the adjacent surface is typically more aggressive because the radius employed is greater than that of the typical rigid pipe.

To address these problems, operators have generally replaced rigid bars and large flat plates with air foils. Air foils generally create lift by exploiting the Bernoulli Principal. In aeronautics, the airfoil is commonly the wing or propeller itself, both of which generally create a majority of lift at the leading edge of the airfoil. In the manufacture of fiber webs, an "airfoil" generally refers to an apparatus that spans the width of the web. These airfoils generally have a slot in the bottom of the airfoil that direct air parallel to both the bottom of the airfoil and the direction of the web movement. Because total pressure of a system remains constant, the high dynamic pressure of the air stream (i.e. the pressure of the air stream flowing horizontally) decreases the static (i.e. atmospheric) pressure vertically between the bottom of the airfoil and the web. As a result, the web, and the air under the web is generally drawn to this low pressure area caused by the horizontal airflow parallel to the web. In this manner, airfoils generally provide web support in the draw while reducing web contact.

Although airfoils address many of the problems of the rigid pipe and large flat plate, airflow instabilities near the web can induce web flutter and subsequent web contact with mechanical parts of the dryer, resulting in a coating disturbance or web damage. Web flutter can manifest in many forms, ranging from a violent flapping of the web to a high frequency drumming. Such flapping may be particularly prominent at the web edges. Increasing production speed demands are increasing instances of flutter. Accordingly, there is a long felt to have an airfoil configured to stabilize webs at increasingly higher speeds.

SUMMARY OF THE INVENTION

The problem of web flutter experienced by webs spanning the draw between a drying area of a fiber web manufacturing machine and winder, wherein the web is assisted by airfoils is mitigated by using at least one airfoil having multiple conduits connected to at least one air supply, at least two areas with openings in the form of slots or rows of holes (or elongated openings) are oriented in a direction substantially parallel to the direction of web movement, wherein these openings communicate with the multiple conduits, a Coanda surface disposed adjacent to the openings, and wherein the openings are configured to direct air flowing from the air source through the multiple conduits, through the openings and over the Coanda surface in a direction substantially perpendicular to the direction of web movement.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

An exemplary embodiment in accordance with the present disclosure may be used on active airfoils, in which the air entering the airfoil system is compressed air. Without being bounded by theory, Applicant has discovered that by directing air around the Coanda surface, the negative pressure, or under-pressure generated by the fast-flowing airstream may be desirably increased in order to keep a web in the vicinity of the bottom surface of the airfoil and thereby stabilize the web. In this context, a Coanda surface is to be understood as a surface on which a flow medium, which exits from an opening and follows a surface, exhibits the Coanda effect. The Coanda effect is a widely known and proven follower effect whereby a primary media flow is diverted over a Coanda surface. A description of the features of a Coanda surface and also of the effect of the media flow on the Coanda surface can be found in scientific publications. A Coanda surface is also known as a geometric structure with a shape defined by a mathematical curve called a lemniscate. A fluid stream flowing over a Coanda surface tends to adhere to that surface.

Slots, or rows of multiple holes directing air in a direction perpendicular to the direction of web movement, may be disposed at intervals along the width of an airfoil. The width of the airfoil may desirably span the width of the web. In certain exemplary embodiments, the perpendicular airflow may occur at the edges of the airfoil. In other exemplary embodiments, the airfoil may be divided into sectors, wherein perpendicular airflow is directed at the edges of the airfoil sectors such that the airflow curls around the edges of the sectors to stabilize the web.

By using an apparatus in accordance with the present disclosure, operators may be able to stabilize the web with a low pressure fan. In other exemplary embodiments, the fan may be a middle pressure fan. Accordingly, it is an object of the present disclosure to improve web stabilization generally, and particularly at the web edges while minimizing the need to compress air.

It is a further object of the present disclosure to support tail treading and to support spreading the web during or after tail threading to the full width. An exemplary airfoil can be applied to Tissue Machines ("TM") and Through Air Dryer ("TAD") machines for an active solution.

An embodiment in accordance with the present disclosure may further have a golf ball pattern to improve stability. The golf ball pattern may comprise a series of recesses on the bottom of the airfoil. Without being bounded by theory, air steams may be diverted from a generally horizontal orientation and flow into the series of recesses in accordance with the Coanda Effect. The air moving into the series of recesses may further create areas of low pressure and thereby attract and stabilize the fibrous web. Air flowing over and into the series of recesses that form the golf ball pattern may desirably flow in a direction perpendicular to the direction of web movement, but may also flow in a direction parallel to the web or at other angles.

BRIEF DESCRIPTION OF THE DRAWINGS

The foregoing will be apparent from the following more particular description of exemplary embodiments of the disclosure, as illustrated in the accompanying drawings. The drawings are not necessarily to scale, with emphasis instead being placed upon illustrating the disclosed embodiments.

DETAILED DESCRIPTION OF THE INVENTION

Figure 1:
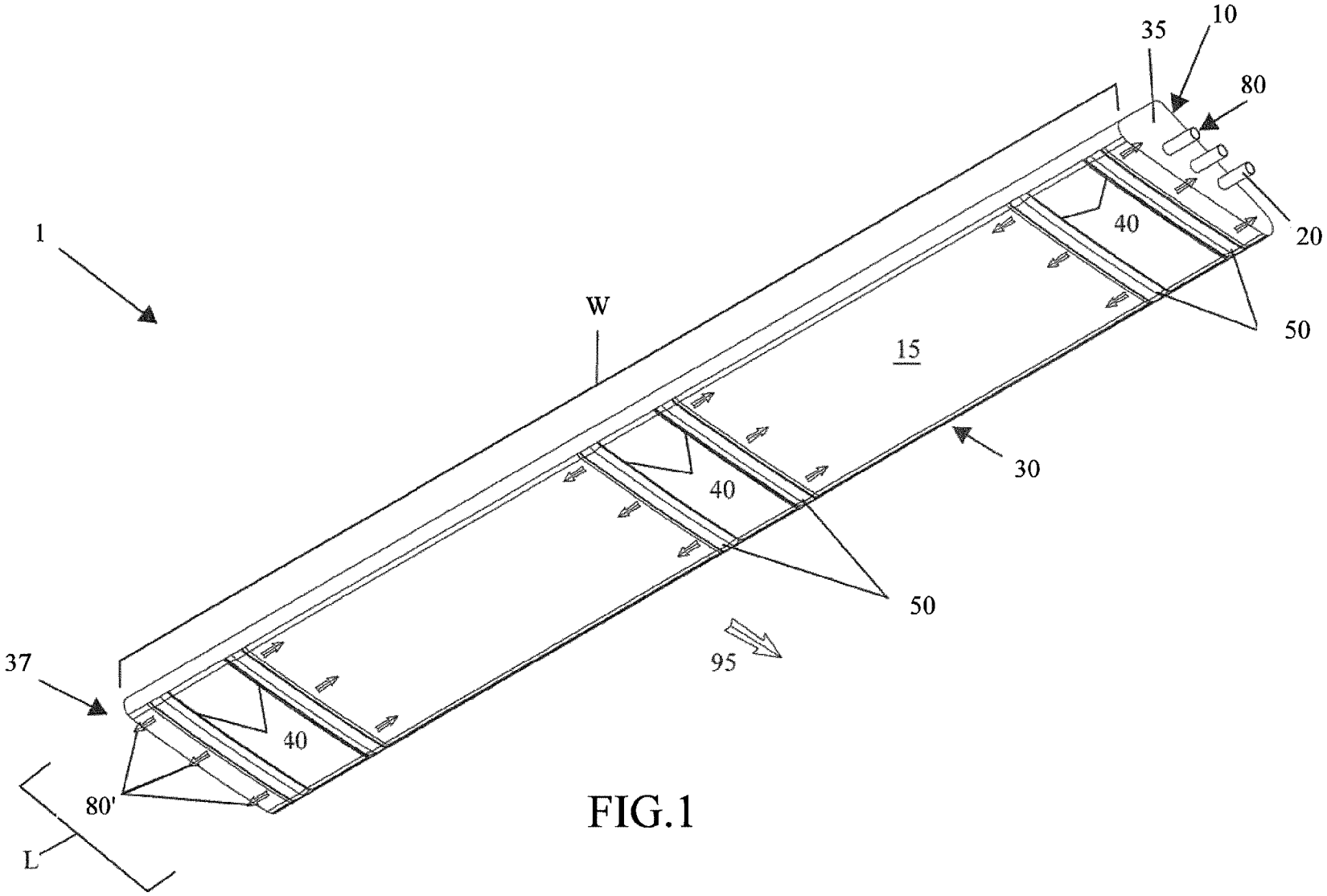
FIG. 1 is a perspective view of an exemplary airfoil depicting perpendicular airflow relative to the direction of web movement.

The following detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Corresponding reference characters indicate corresponding parts throughout the several views. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

FIG. 1 is a perspective view of an exemplary airfoil web stabilizer 1 in accordance with the present disclosure. The top 10 of the airfoil housing 15 may be sloped, have rounded corners, a combination thereof, or otherwise configured to reduce dust collection. In the attached figures, the top 10 of the airfoil housing 15 is generally sloped. Coanda surfaces 50 may be disposed on the bottom 30 of the airfoil housing 15 and be generally parallel to the direction of web movement 95. In the depicted embodiment, the Coanda surfaces 50 are parallel to the length L of the airfoil web stabilizer 1. The airfoil web stabilizer 1 may have a width W that spans the width of the web w (see FIG. 4). The airfoil width W may be greater than the web width w. In other embodiments, the airfoil width W may be less than the web width w. Other exemplary embodiments may comprise more than one airfoil web stabilizer 1, wherein each exemplary airfoil web stabilizer 1 has a width W that is less than the web width w and each airfoil web stabilizer 1 and is arranged along the web width w. In certain exemplary embodiments, the more than one airfoil web stabilizer 1 having a width W that is less than the web width w may be adjacently disposed. In other exemplary embodiments, the more than one airfoil web stabilizer 1 having a width W that is less than the web width w may be staggered along the web width w and web length 1 (see FIG. 4).

Operators generally use one or more airfoil web stabilizers 1 in the draw between the drying end of the web-manufacturing machine and the winder. Multiple airfoil web stabilizers 1 in accordance with the present disclosure may span the draw. In other exemplary embodiments, an airfoil web stabilizer 1 with a greater length L may be used in place of multiple airfoil web stabilizers 1 with lesser lengths L.

In an exemplary airfoil web stabilizer 1, air 80 may flow through one or more air inlets 20 communicating with an air source (not depicted). The air source may be a fan, such as a low pressure fan or medium pressure fan. In other exemplary embodiments, the air source may be a repository of compressed air. In still other exemplary embodiments, the air source may be the Yankee dryer hood or other equipment component within the web production line. The air inlets 20 extend through the edge 35 of the airfoil housing 15 and direct air 80 to conduits (90 FIG. 4), which in turn communicate with openings 40 to direct the air 80 into an air jet 80' substantially perpendicular to the direction of web movement 95. Affixing receptacles (23, FIG. 2.) may engage the airfoil housing 15 at the edge 35 and opposite edge 37.

Figure 2:
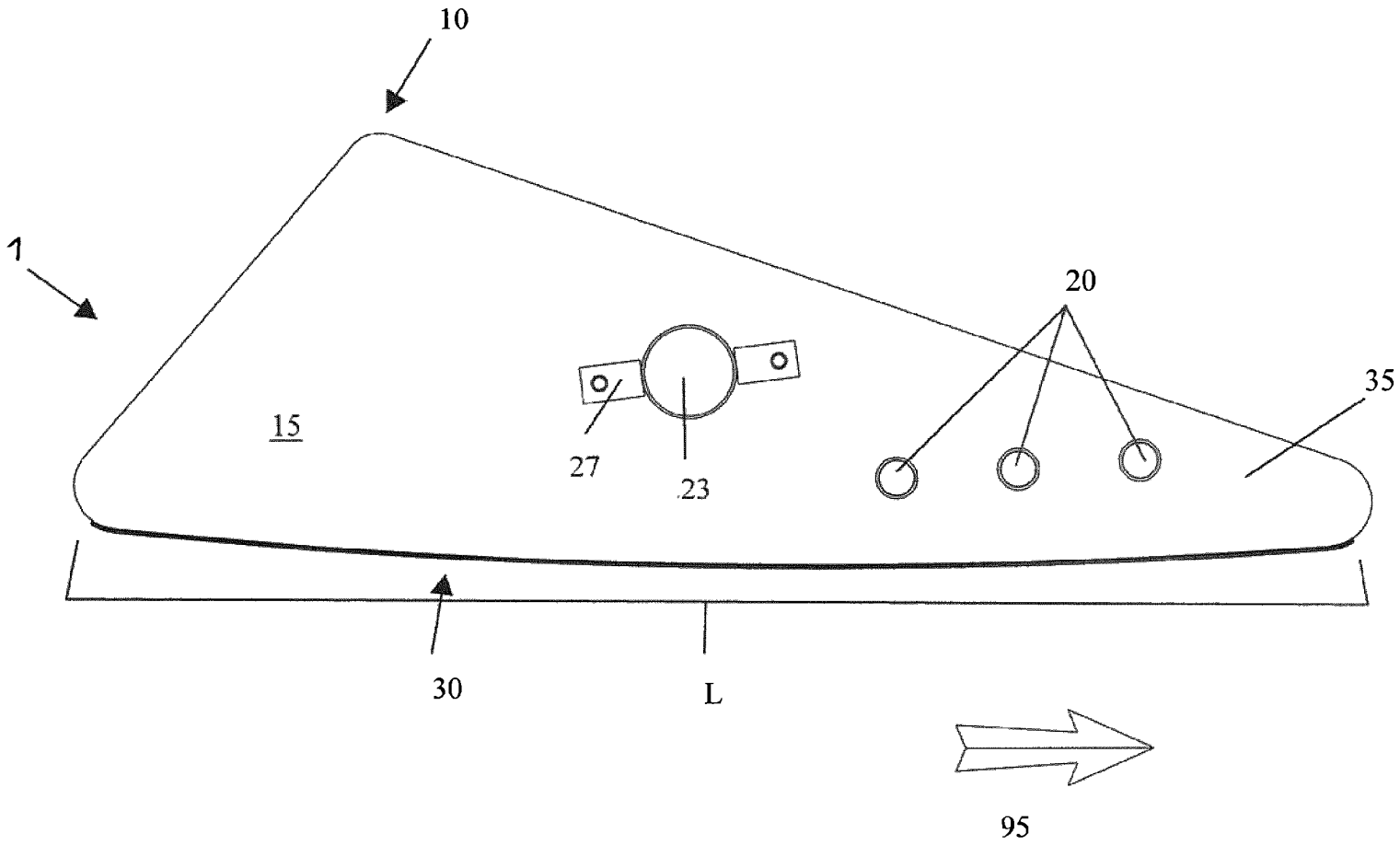
FIG. 2 is a side view of an exemplary airfoil.

FIG. 2 is a side view of an exemplary airfoil web stabilizer 1. This view more clearly shows that the bottom 30 of the airfoil web stabilizer 1 is oriented in a direction substantially parallel to the direction of web movement 95. The length L of the airfoil web stabilizer 1 may be varied such that different airfoil web stabilizers 1 may be used operatively to facilitate different applications within the draw. This side view further illustrates the top 10 of the airfoil housing 15 having sloped surfaces and rounded corners. The sloped surfaces and rounded corners reduce fine tissue dust accumulation on the airfoil web stabilizer 1. Without the sloped surfaces, accumulated dust tends to fall onto the fragile web periodically. The web 75 (see FIG. 4) may not be able to support the weight of the dust and therefore, the risk of web breakage increases without a sloped top 10. Even if the web 75 does not break, dust entrapped in the web negatively affects overall product quality.

FIG. 2 further depicts air inlets 20 extending into the edge 35 of the airfoil housing 15. Fasteners can engage fastener flanges 27 of an affixing receptacle 23 to the edge 35 of the airfoil housing 15. Once installed along the draw, the affixing receptacles 23 permit operators to adjust the angle and position of airfoil web stabilizer 1.

Figure 3:
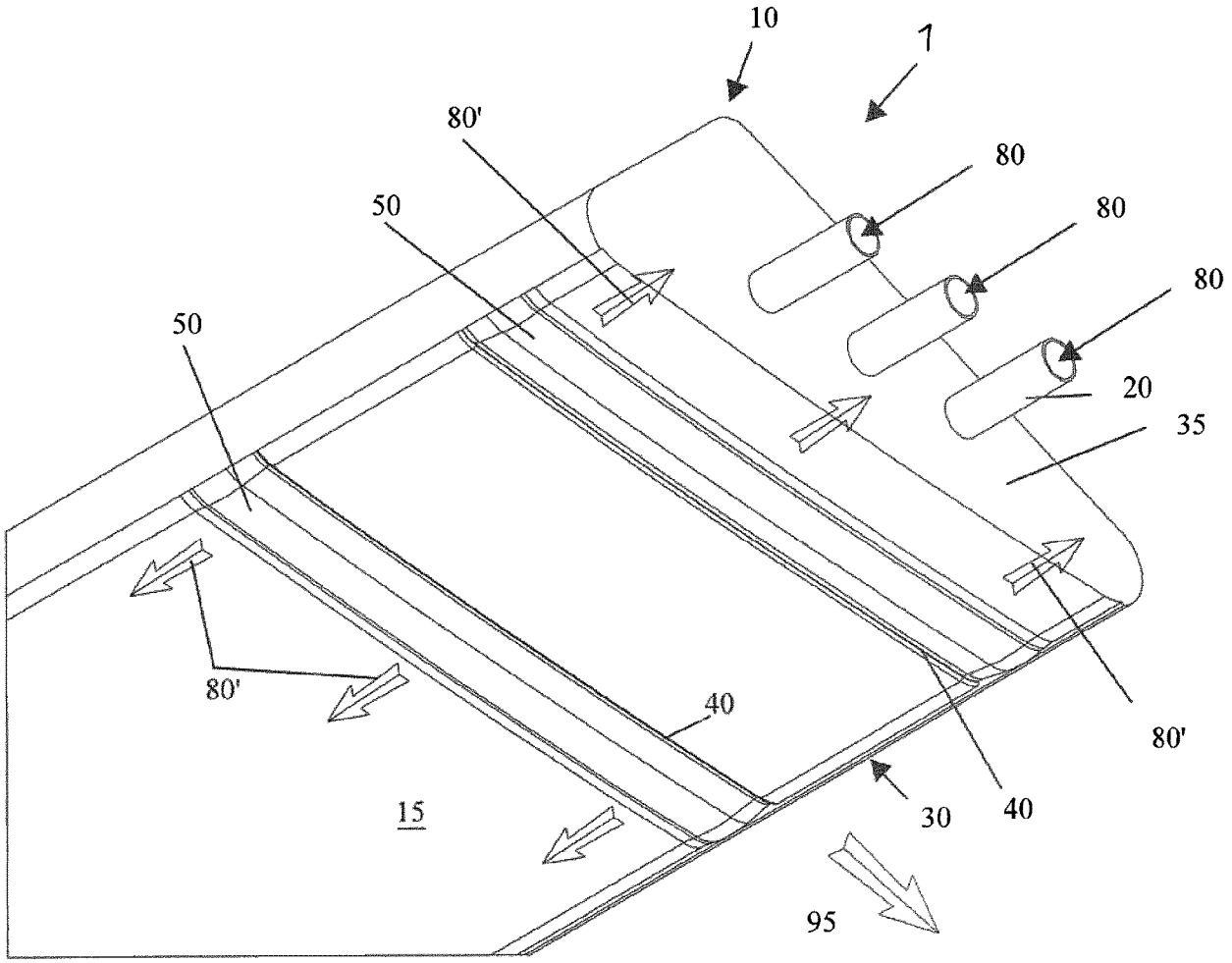
FIG. 3 is a detailed perspective view of an exemplary airfoil depicting the path of a perpendicular air jet along the bottom of the airfoil and around an edge of an airfoil.
Figure 4:
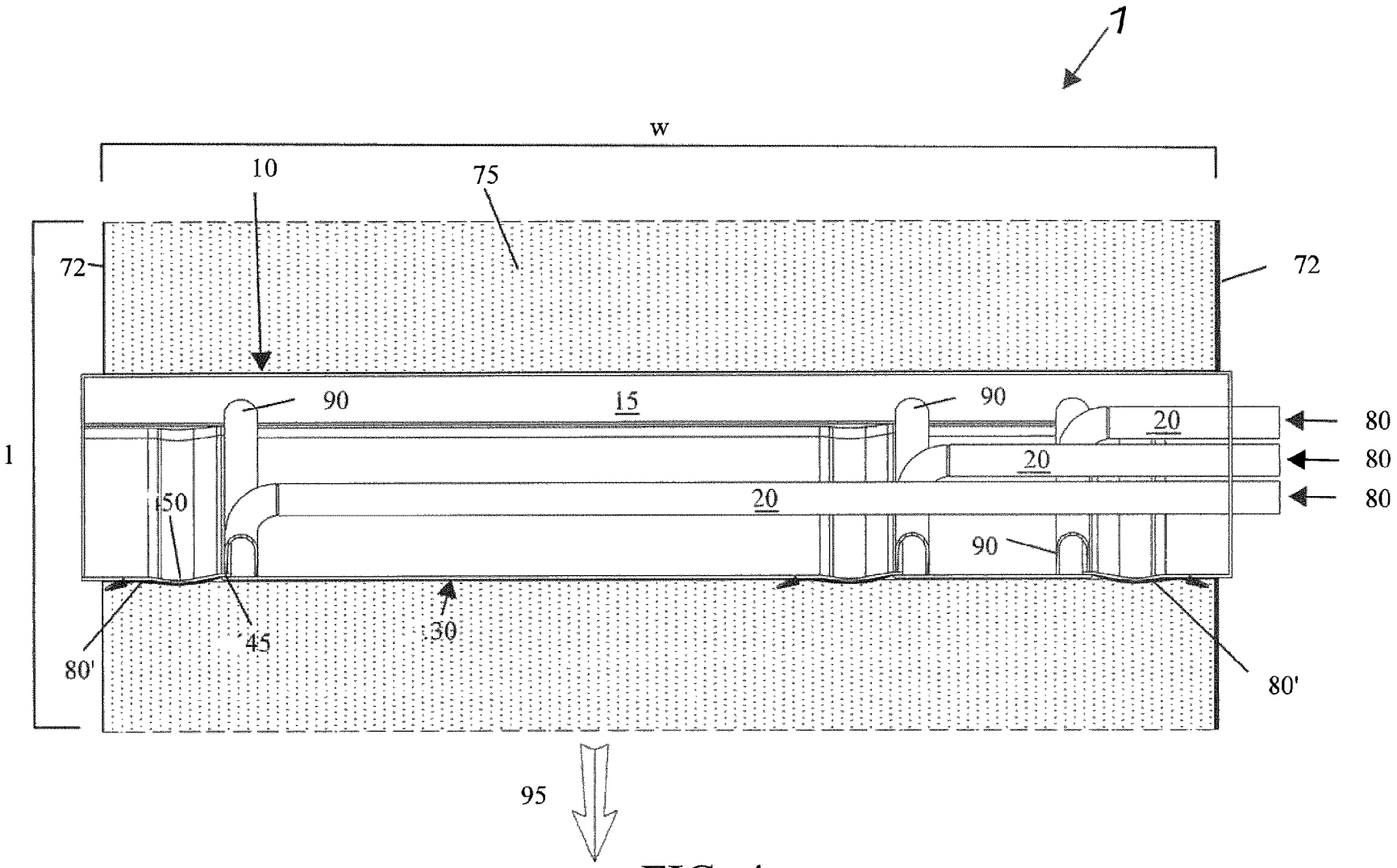
FIG. 4 is a cross-sectional view of an exemplary airfoil further depicting air inlets communicating with conduits within the airfoil.

FIG. 3 is a close-up perspective view of the edge 35 of an exemplary airfoil web stabilizer 1. Air 80 enters air inlets 20 extending through the edge 35 of the airfoil housing 15. A substantially perpendicular air jet 80' flowing out of openings 40 disposed at the bottom 30 of the airfoil housing 15 generally flow around Coanda surfaces 50. Furthermore, at the edge 35 of the airfoil housing 15, the perpendicular air jet 80' may generally curl upwardly around the edge 35 due to the Coanda Effect. This curling action further stabilizes the edge (72, FIG. 4) of the web 75 (FIG. 4). The direction of air jet 80' flow is substantially perpendicular to the direction of web movement 95. FIG. 3 further depicts a sloped top 10 of the airfoil housing 15.

FIG. 4 is a cross-sectional perspective view of an exemplary airfoil web stabilizer 1, which further illustrates the air inlets 20 extending into the airfoil web stabilizer 1 and the conduits 90 disposed generally parallel to the direction of web movement 95. This cross-sectional view removes a section of the top 10 of the airfoil housing 15 to expose the inside of the airfoil web stabilizer 1. Air 80 flows through the air inlets 20 and into the conduits 90. In this exemplary embodiment, the openings are slots 45 characterized in that the slots 45 have a narrow gap (36, FIG. 6) between two surfaces that form the air 80 into an air jet 80' configured to exit the bottom 30 of the airfoil housing 15 in a direction substantially perpendicular to the direction of web movement 95. In the depicted embodiment, the slots 45 are not configured to first direct an air jet downwardly toward the web 75; rather, each slot 45 is configured to direct air flow into a perpendicular air jet 80' before the air 80 exits the conduit 90 at the bottom 30 of the airfoil housing 15. In other exemplary embodiments, a slot 45 may be further subdivided into a series of perpendicular holes defined by perpendicular walls disposed within the continuous slot opening.

Without being bounded by theory, the air jet 80' moving over Coanda surfaces 50 creates areas of low pressure and attracts the web 75 toward the bottom 30 of the airfoil housing 15 due to the Coanda Effect. On the right side of FIG. 4, two slots 45 create air jets 80' in a direction perpendicular to the direction of web movement 95, but in directions opposite to each other. The closely spaced slots 45 and Coanda surfaces 50 can be used to convey the trailing edge of the web 75 through the draw upon equipment startup. The trailing edge of the web 75 generally has a width that is less than the width w of the web 75 during regular production. As the closely spaced slots 45 and Coanda surfaces 50 on the right side of FIG. 4 convey the trailing edge through the draw, the width of the web 75 gradually increases to regular production levels, wherein the slot 45 and Coanda surface 50 on the left side of the airfoil web stabilizer 1 attracts the left edge 72 of the web 75.

Figure 5:
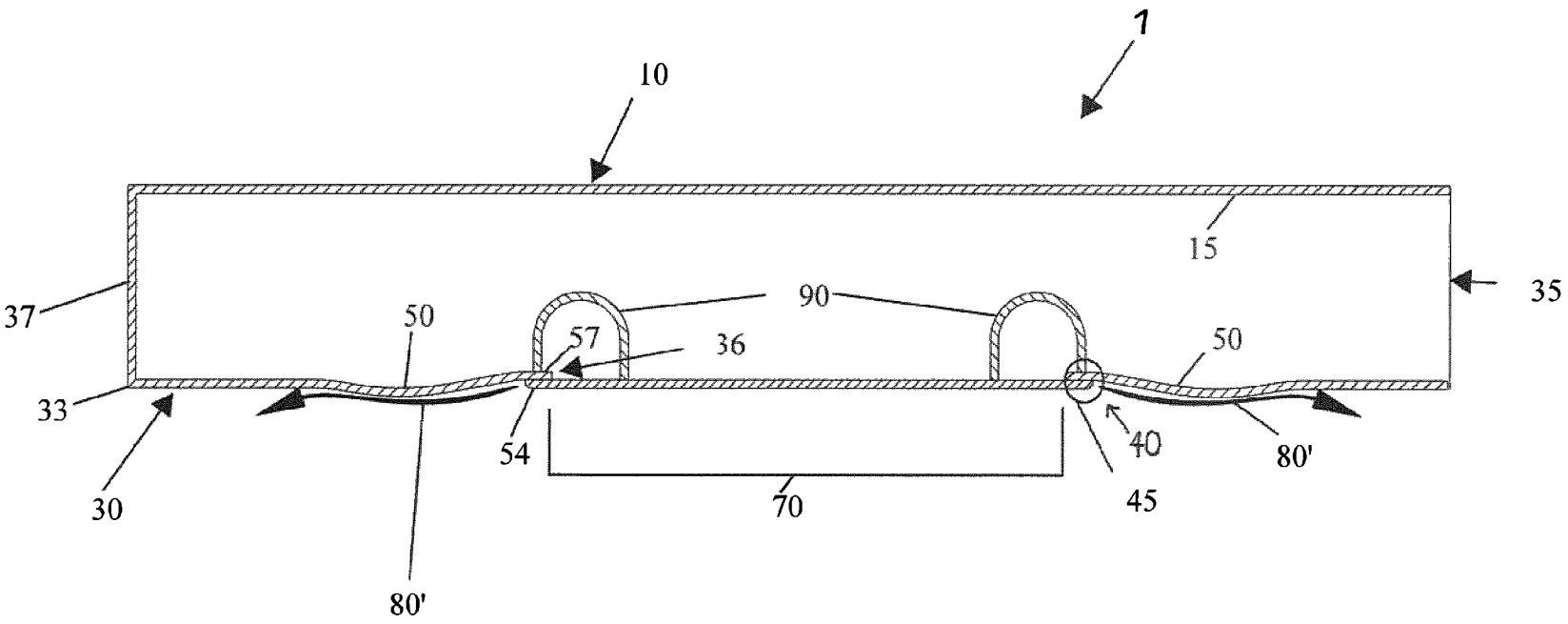
FIG. 5 is a cross-sectional side view of an exemplary airfoil detailing areas of low pressure created by the exemplary arrangement of openings and Coanda surfaces.

FIG. 5 is a cross-sectional side view of a detailed opening 40 wherein the opening 40 is a slot 45 and Coanda surface 50 in accordance with the present disclosure. Each slot 45 fluidly communicates with a corresponding conduit 90. The cross-sectional side view bisects the top 10 and bottom 30 of airfoil housing 15. The airfoil web stabilizer 1 makes use of perpendicular air jets 80' flowing over a Coanda surface 50 toward a first edge 35 and a perpendicular air jet 80' flowing over a Coanda surface 50 in the direction of an opposite edge 37. Coanda surfaces 50 with oppositely disposed perpendicular air jets 80' are desirably deployed in pairs along the width W of the airfoil web stabilizer 1. The area between the two depicted Coanda surfaces 50 is an etch stabilizing zone 70, which helps to spread the web 75 after tail threading. In certain exemplary embodiments, a slot 45 may be deposed proximate to the edge 35 or opposite edge 37 of the airfoil housing 15 without a corresponding Coanda surface 50. That is, the corner 33 of the edge 35 or opposite edge 37 and the bottom 30 of the airfoil housing 15 may be sufficient to induce the Coanda Effect and thereby reduce fluttering at the web edges 72 without having a separate Coanda surface proximate to the corner 33 at the edge 35 or opposite edge 37 and the bottom 30 of the airfoil housing 15.

Without being limited by theory, applicant has discovered that by blowing perpendicular air jets 80' in opposite directions around the Coanda surfaces 50, the moving air creates areas of low pressure, which attracts the stagnant air located in the etch stabilizing zone 70. The movement of air in the etch stabilizing zone 70 toward the perpendicular air jets 80' likewise creates areas of low pressure, or under pressure in the etch stabilizing zone 70. This under pressure in the etch stabilizing zone 70 attracts the web moving in a perpendicular direction 95 and stabilizes the web 75 without having the airfoil physically contact the web 75. The movement of air around the corner 33 and edges 35, 37 of the airfoil housing 15 further reduces fluttering at the web edges 72. In active air foils, the air flowing through the slot 45 is desirably at a constant rate of speed and pressure.

Without being bounded by theory, because the under pressure in the stabilizing zone 70 is defined substantially by perpendicular air jets 80' exiting proximate slots 45 at a constant rate of speed and pressure, expanding air from neighboring slot 45 is less likely to cause pressure variations within the stabilizing zone 70 because the air closer to the slot 45 is more compressed than air further along the width W of the airfoil web stabilizer 1. In the depicted embodiments, the opening 40 is a slot 45. Therefore, the under pressure within the etch stabilizing zone 70 may have greater consistency over conventional designs, and therefore stabilize the web 75 with greater consistency than designs that direct air jets parallel to the direction of web movement 95.

In the depicted embodiment, the slots 45 are not configured to first direct an air jet downwardly toward the web; rather, each slot 45 is configured to direct air flow into a perpendicular air jet 80' before the air 80 exits the conduit 90 at the bottom 30 of the airfoil housing 15. An exemplary slot 45 may be formed by a top ledge 57 defining a gap 36 over a bottom ledge 54. One side of the conduit 90 may be desirably engaged to an area defining the top ledge 57.

Figure 6:
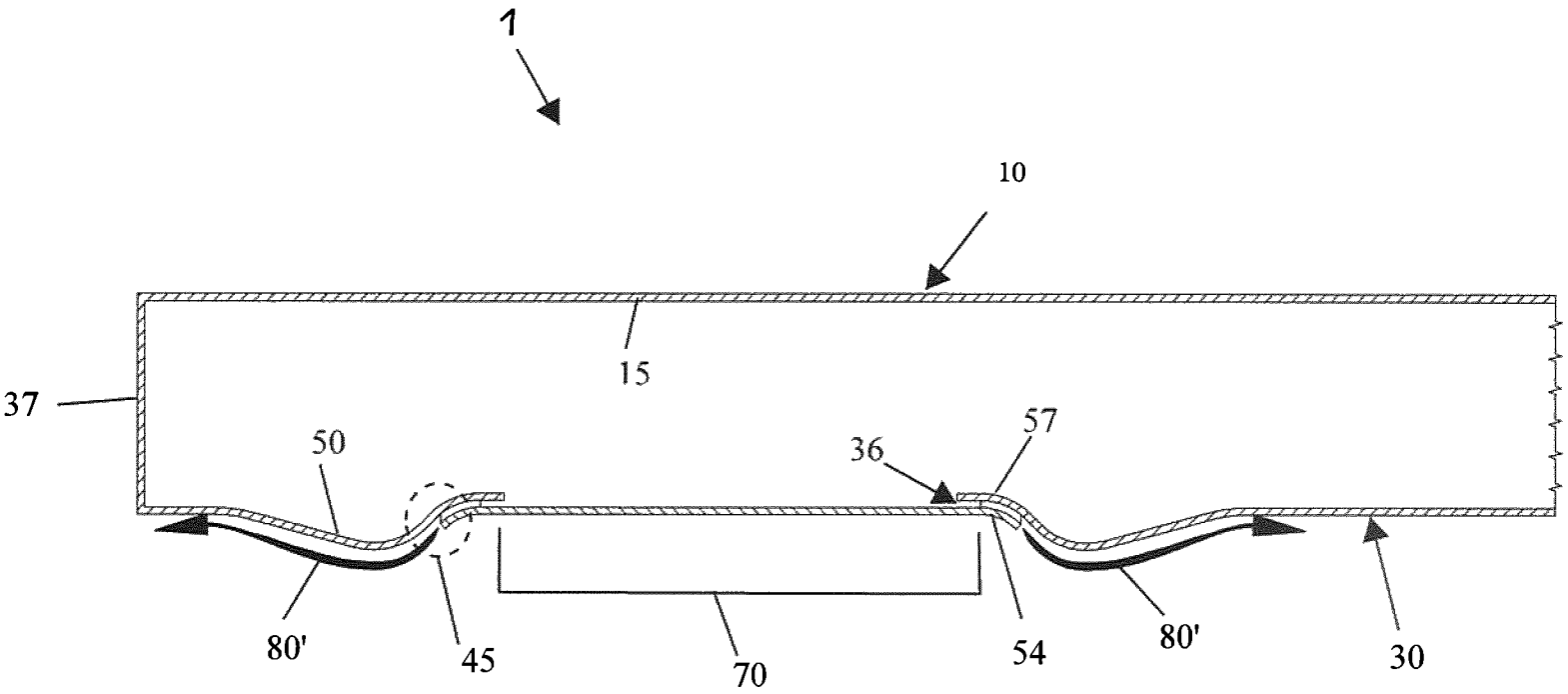
FIG. 6 is a cross-sectional side view of an exemplary airfoil detailing the areas of low pressure created by an exemplary arrangement of slots and Coanda surfaces.

FIG. 6 is a cross-sectional side view of a detailed opening and Coanda surface 50 in accordance with the present disclosure where the opening is a slot 45. The cross-sectional side view bisects the top 10, opposite edge 37, and bottom 30 of airfoil housing 15. The slot 45 may desirably be between 0.1 millimeters ("mm") and 1 mm. In other exemplary embodiments, the slot 45 may be wider or narrower depending on the size of the airfoil web stabilizer 1 and production line operating parameters. The slot 45 comprises a top ledge 57 oppositely disposed a bottom ledge 54, wherein the top ledge 57 and bottom ledge 54 define a gap 36 between the top edge 57 and bottom ledge 54 wherein the gap 36 extends the length L (FIG. 2) of the airfoil housing 15. The gap 36 forms an air jet 80' within the airfoil housing 15 and directs the air jet 80' horizontally. In certain exemplary embodiment, the slot 45 may direct the air jet 80' downward slightly to follow the contour of the Coanda surface 50. In other exemplary embodiments, the slots 45 may not direct the air jet 80' downwardly to follow the contour of the Coanda surface 50.

The etch stabilizing zone 70 is disposed between the two oppositely disposed slots 45 directing air jets 80' in opposite substantially horizontal directions, but also in a direction substantially perpendicular to the direction of web movement 95.

Figure 7:
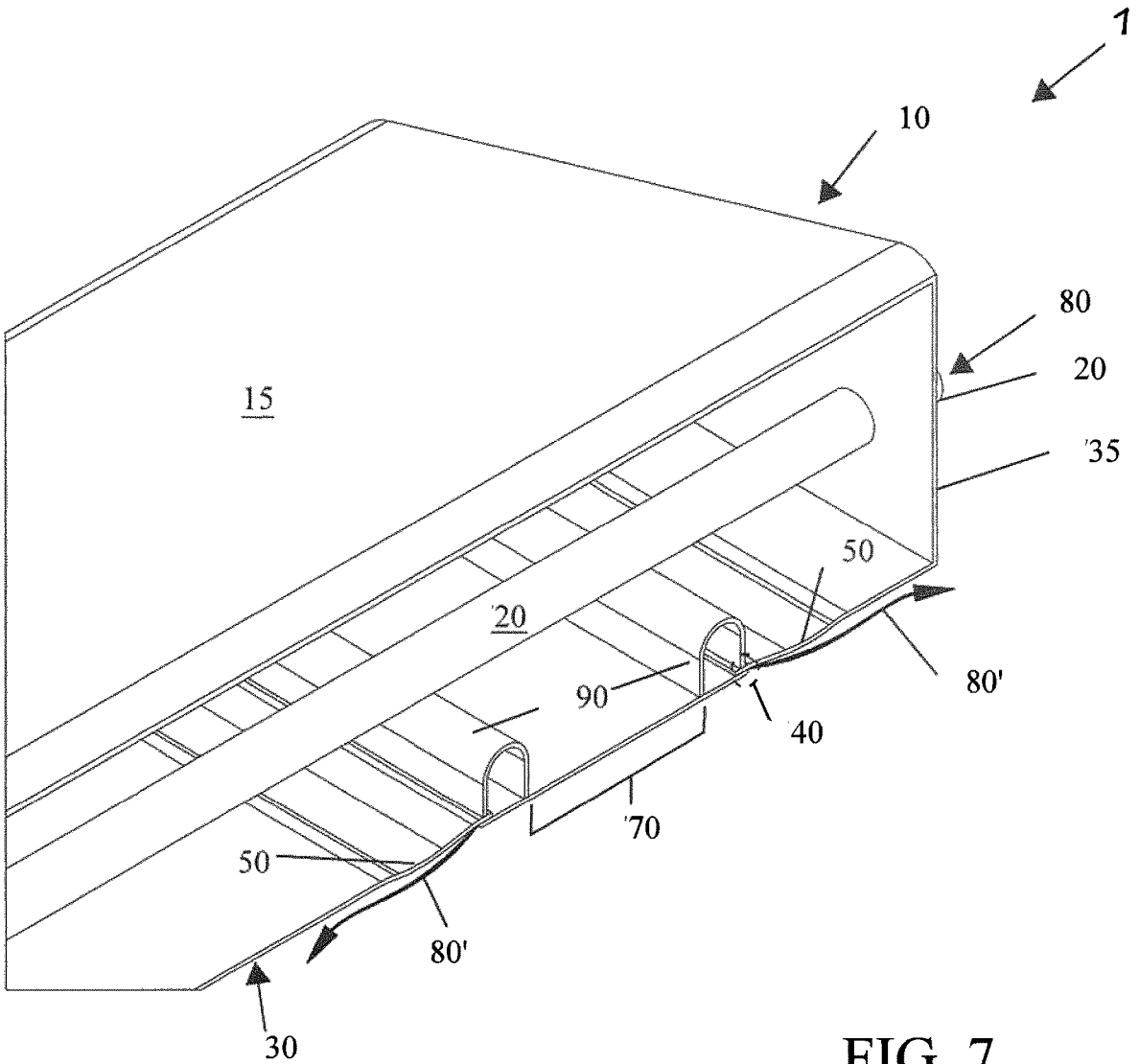
FIG. 7 is a cross-sectional perspective view of an exemplary airfoil.

FIG. 7 is a cross-sectional perspective view of an exemplary air foil which illustrates the conduits 90 in greater detail. The cross-sectional perspective view intersects the top 10, edge 35, and bottom 30 of airfoil housing 15. Air 80 flows through air inlet 20 and into conduits 90. In this manner, the conduits 90 are in fluid communication with the air inlets 20. The air 80 flows through the conduits 90 and exits the conduits through an opening 40 configured create an air jet 80'. The opening 40 directs the air jet 80' over a Coanda surface 50 in a direction substantially horizontal to the bottom 30 of the airfoil housing 15 and in a direction substantially perpendicular to the length L (FIG. 2) of the airfoil web stabilizer 1. "Substantially perpendicular to the length L of the airfoil web stabilizer 1 is also substantially perpendicular to the direction of web movement 95. In certain exemplary embodiments, the conduits 90 may receive air directly from an air source (not shown), or the air inlets 20 may communicate with the conduits 90 through another side of the airfoil 1, such as through the top 10 of the airfoil web stabilizer 1. The etch stabilizing zone 70 is disposed between the two oppositely disposed openings 40 directing air jets 80' in opposite substantially horizontal directions, but also in a direction substantially perpendicular to the direction of web movement 95.

Figure 8:
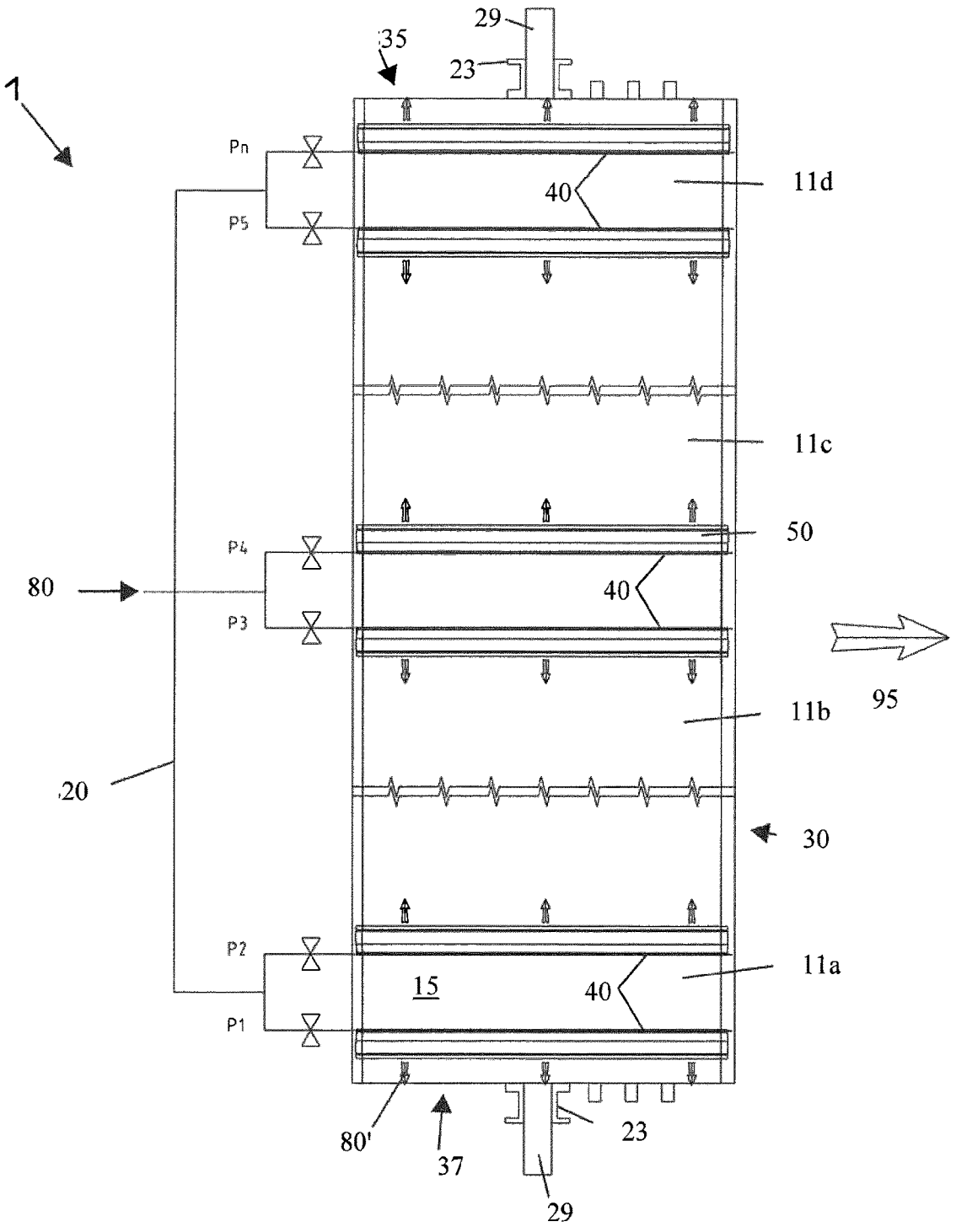
FIG. 8 is a bottom-up view of an exemplary airfoil having multiple sectors.

FIG. 8 is a bottom-up view of an exemplary airfoil web stabilizer 1 in which the airfoil 1 has been divided into sectors 11*a*, 11*b*, 11*c*, 11*d*, etc. The air jets 80' exit the openings 40 at the bottom 30 of the airfoil housing 15 in a direction perpendicular to the direction of web movement 95 and flow over the Coanda surfaces 50. The sectors 11*a*, 11*b*, 11*c*, 11*d* further exploit the Coanda Effect by providing more edges and curved surfaces around which perpendicular jets of air 80' may curve. The curving air creates additional low pressure zones which may increase web stabilization. In this exemplary embodiment, the conduits 90 (FIG. 7) desirably communicate with air inlets 20 extending into the airfoil housing 15. The air inlet 20 are represented schematically and fluidly communicate with conduits 90, which are semantically represented in FIG. 8 as P1, P2, P3, P4, P5, and Pn. Air 80 flows through the air inlets 20 and conduits P1, P2, P3, P4, P5, and Pn before exiting the bottom 30 of the airfoil housing 15 at openings 40.

Affixing receptacles 23 are attached to the edge 35 and opposite edge 37 of the airfoil housing 15. A bar 29 extends into the affixing receptacles 23 to position the airfoil web stabilizer 1 along the draw.

Figure 9:
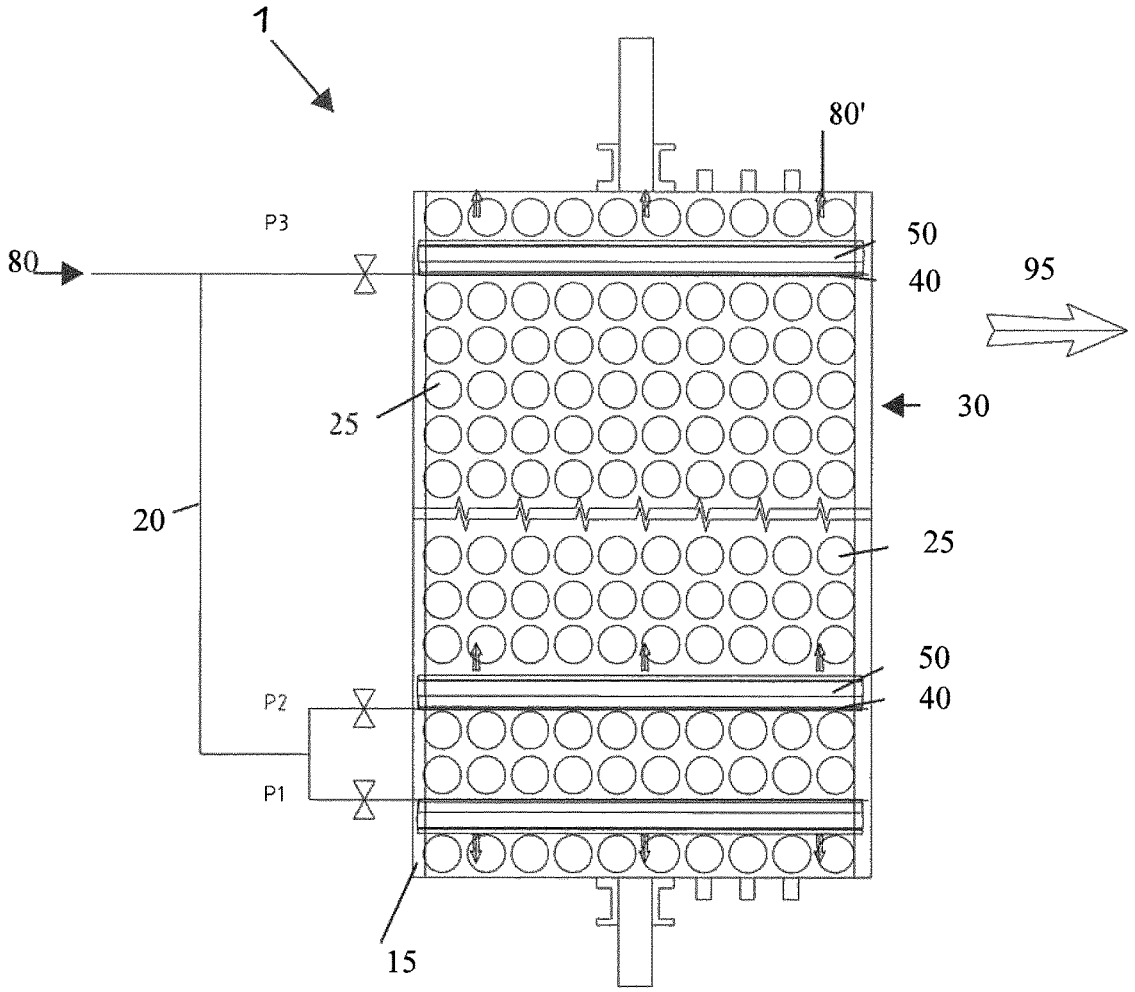
FIG. 9 is a bottom-up view of an exemplary airfoil having a golf ball pattern on the bottom of the airfoil.

FIG. 9 is a bottom-up view of an exemplary airfoil web stabilizer 1 having golf ball divots 25 on the bottom 30 of the airfoil housing 15. The golf ball pattern further increases the Coanda Effect. Because of the golf ball divots 25 of the bottom surface 30 of the airfoil, the speed of the air in the vicinity of the golf ball surface will increase. The increase speed of air movement will in turn additionally reduce the pressure and will create lift forces that will stabilize web. It will be understood that the golf ball pattern may be used in conjunction with any of the embodiments disclosed in FIGS. 1 through 10. In certain exemplary embodiments, the golf ball surface, comprising golf ball divots 25 may be disposed after Coanda surfaces 50, such that the perpendicular air jets 80' flowing out of the openings 40 at the bottom 30 of the airfoil housing 15 pass the Coanda surface 50 before encountering the golf ball divots 25.

FIG. 9 further depicts air 80 entering the airfoil housing 15 through an air inlet 20. The air inlet 20 conveys the air 80 to conduits 90, which are schematically depicted in FIG. 9 as P1, P2, and P3.

Figure 10:
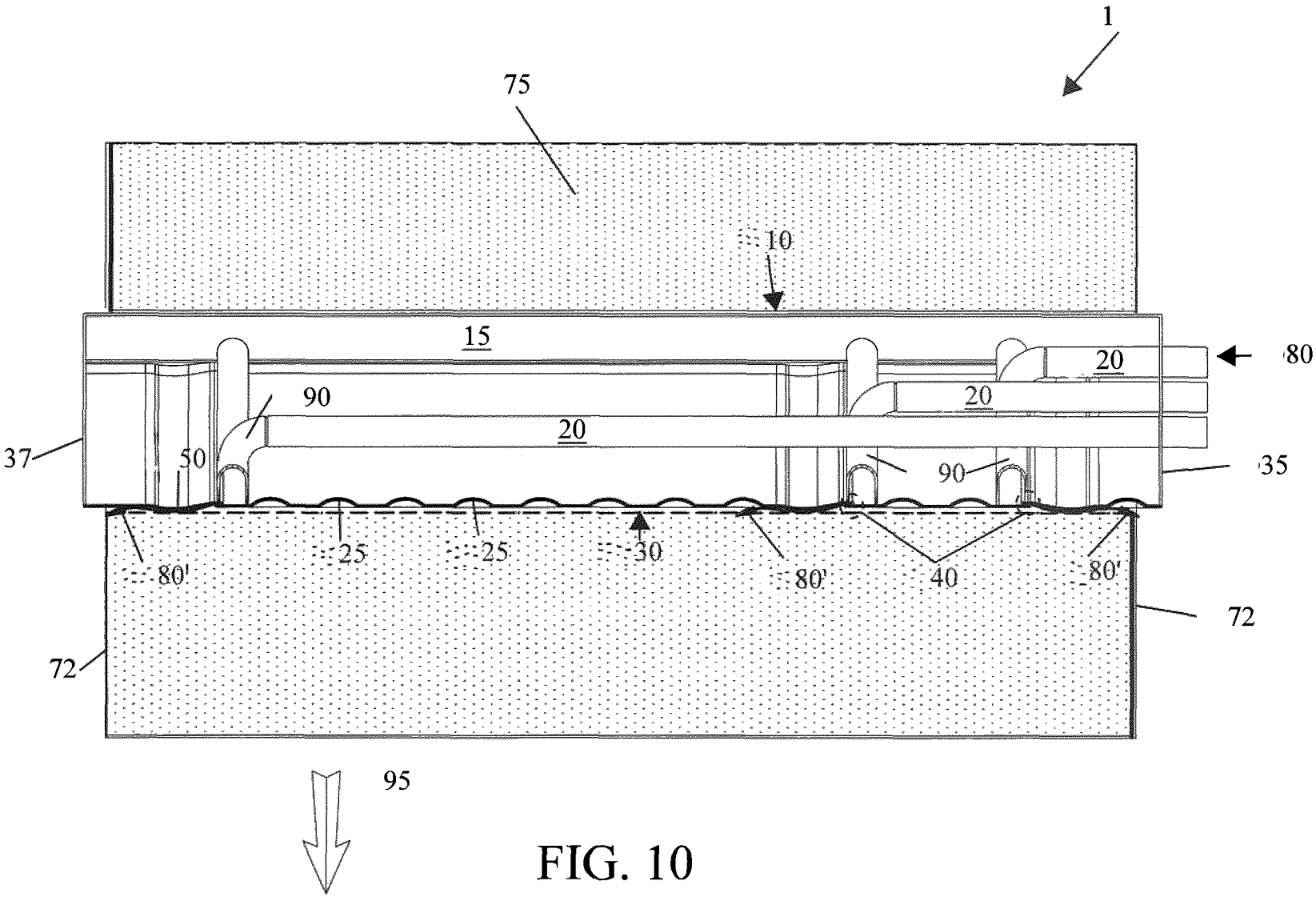
FIG. 10 is a side cross-sectional view of an exemplary airfoil having a golf ball pattern on the bottom of the airfoil.

FIG. 10 is a side cross-sectional view of an exemplary air foil 1 having the golf ball pattern comprising golf ball divots 25. The cross-sectional line intersects the top 10, edge 35, opposite edge 37, and bottom 30 of the airfoil housing 15. Air 80 enters the airfoil housing 15 through air inlets 20. The air inlets 20 fluidly communicate with conduits 90 and thereby convey air 80 from the air inlets 20 to the conduits 90. Openings 40 fluidly communicating with the conduits 90 expel the air 80 as an air jet 80' in a direction perpendicular to the direction of the web movement 95. The perpendicular air jets 80' curl around the Coanda surface 50 disposed proximate to the opening 40. Furthermore, the perpendicular air jets 80' can curl around the bottom 30 of the airfoil housing 15 toward the edge 35 or opposite edge 37 of the airfoil housing 15 to create additional Coanda Effect areas and thereby stabilize the web edges 72.

The perpendicular air jets 80' curve into the golf ball divots 25 thereby increasing the rate of air speed in the golf ball divots 25, thereby creating multiple areas of low pressure to stabilize the web 75. The golf ball patterns may provide sufficient low pressure areas and stability, that a passive airfoil may be used. In certain exemplary embodiments, the bottom 30 of the airfoil housing 15 may be curved in a convex shape. The curved orientation may facilitate web movement 95 with air flow.

An exemplary airfoil web stabilizer comprises: an airfoil housing having a top and a bottom, an air inlet extending into the airfoil housing, wherein the air inlet is in fluid communication with a conduit disposed inside the airfoil housing along a length of the airfoil housing, wherein the conduit is in fluid communication with an area of the bottom of an airfoil housing defining an opening in the bottom of the airfoil housing, a Coanda surface disposed on the bottom of the airfoil housing adjacent to the area defining the opening in the bottom of the airfoil housing, wherein the opening is configured to direct air horizontally over the Coanda surface along a width of the bottom of the airfoil housing, wherein the width is perpendicularly disposed to the length of the airfoil housing.

An exemplary airfoil web stabilizer may have an airfoil housing further comprising sloped surfaces. In another exemplary airfoil web stabilizer, the opening may be a slot. In still other exemplary airfoil web stabilizers, the opening may be a series of holes. In yet other exemplary embodiments, the airfoil web stabilizer may further comprise an air source fluidly communicating with the air inlet.

In an exemplary airfoil web stabilizer, the area defining the opening in the bottom of the airfoil housing may further comprise a top ledge oppositely disposed a bottom ledge, wherein the top ledge and bottom ledge define a gap between the top edge and bottom ledge and wherein the gap extends the length of the airfoil housing. In another exemplary embodiment, the airfoil web stabilizer may have multiple areas defining openings in the bottom of the airfoil housing, wherein each opening is configured to direct air over a Coanda surface in a direction perpendicular to the length of the airfoil housing.

Another exemplary airfoil web stabilizer may further comprise a series of golf ball divots at the bottom of the airfoil housing. The golf ball divot in the series of golf ball divots may be disposed proximate to a Coanda surface such that air jets exiting the opening flows over the Coanda surface before flowing across the golf ball divot.

In yet another exemplary embodiment, a web stabilizing system may comprise: an airfoil comprising an airfoil housing having a top and a bottom, an air inlet extending into the airfoil housing, wherein the air inlet fluidly communicates with a conduit within the airfoil housing, an area in the bottom of the airfoil housing defining an opening, wherein the conduit is in fluid communication with the area of the bottom of the airfoil housing defining an opening, a Coanda surface on the bottom of the airfoil housing, wherein the Coanda surface is adjacently disposed to the opening in the bottom of the airfoil housing, a web suspended under the bottom of the airfoil housing, wherein the web moves in a direction parallel to a length of the bottom of the airfoil housing, wherein air flowing through the opening flows over the Coanda surface in a direction perpendicular to the direction of web movement.

An exemplary web stabilizing system may further comprise multiple openings in the bottom of the airfoil housing, wherein half of the openings direct air perpendicular to the direction of web movement toward an edge of the airfoil housing and wherein half of the openings direct air perpendicular to the direction of web movement toward an opposite edge of the airfoil housing.

While this invention has been particularly shown and described with references to exemplary embodiments thereof, it will be understood by those skilled in the art that various changes in form and details may be made therein without departing from the scope of the invention encompassed by the appended claims.

The invention claimed is:

1. A web stabilizing system comprising:

an airfoil (1) comprising an airfoil housing (15) having a top (10) and a bottom (30);

an air inlet (20) extending into the airfoil housing (15), wherein the air inlet (20) is in fluid communication with a conduit (90) disposed inside the airfoil housing (15) along a length (L) of the airfoil housing (15), wherein the conduit (90) is in fluid communication with an area of the bottom (30) of an airfoil housing (15) defining an opening (40, 45) in the bottom (30) of the airfoil housing (15);

a Coanda surface (50) disposed on the bottom (30) of the airfoil housing (15) adjacent the area defining the opening (40, 45) in the bottom (30) of the airfoil housing (15), wherein the opening (40, 45) is configured to direct air (80') horizontally over the Coanda surface (50) along a width (W) of the bottom (30) of the airfoil housing (15), wherein the width (W) is perpendicularly disposed to the length (L) of the airfoil housing (15)

a web (75) suspended directly under the bottom (30) of the airfoil housing (15), wherein the web (75) moves in a direction (95) parallel to a length (L) of the bottom (30) of the airfoil housing (15), wherein air (80') flowing through the opening (40, 45) flows over the Coanda surface (50) in a direction perpendicular to the direction (95) of web movement, wherein the bottom (30) of the airfoil housing (15) further comprises a golf ball pattern (25).

2. The web stabilizing system of claim 1, wherein the top (10) of the airfoil housing (15) further comprises sloped surfaces.

3. The web stabilizing system of claim 2, wherein the opening (40) is a slot (45).

4. The web stabilizing system according to claim 2, wherein the opening (40) is a series of holes.

5. The web stabilizing system according to claim 1, wherein the opening (40) is a slot (45).

6. The web stabilizing system according to claim 1, wherein the opening (40) is a series of holes.

7. The web stabilizing system according to claim 1, further comprising an air source fluidly communicating with the air inlet (20).

8. The web stabilizing system according to claim 1, wherein the area defining the opening (40, 45) in the bottom (30) of the airfoil housing (15) further comprises a top ledge (57) oppositely disposed a bottom ledge (54), wherein the top ledge (57) and bottom ledge (54) define a gap (36) between the top ledge (57) and bottom ledge (54).

9. The web stabilizing system according to claim 8, wherein the gap (36) extends the length (L) of the airfoil housing (15).

10. The web stabilizing system according to claim 9, wherein the stabilizer (1) comprises multiple areas defining openings (40, 45) in the bottom (30) of the airfoil housing (15) and each opening (40, 45) is configured to direct air (80') over a Coanda surface (50) in a direction perpendicular to the length (L) of the airfoil housing (15).

11. The web stabilizing system according to claim 1, wherein the stabilizer (1) comprises multiple areas defining openings (40, 45) in the bottom (30) of the airfoil housing (15).

12. The web stabilizing system according to claim 11, wherein each opening (40, 45) is configured to direct air (80') over a Coanda surface (50) in a direction perpendicular to the length (L) of the airfoil housing (15).

13. The web stabilizing system of claim 1, wherein the golf ball pattern (25) is disposed proximate to a Coanda surface (50) such that air jets (80') exiting the opening (40, 45) flows over the Coanda surface (50) before flowing across the golf ball pattern (25).

14. A web stabilizing system comprising:

an airfoil (1) comprising an airfoil housing (15) having a top (10) and a bottom (30);

an air inlet (20) extending into the airfoil housing (15), wherein the air inlet (20) is in fluid communication with a conduit (90) disposed inside the airfoil housing (15), wherein the conduit (90) is in fluid communication with an area of the bottom (30) of an airfoil housing (15) defining an opening (40, 45) in the bottom (30) of the airfoil housing (15);

a Coanda surface (50) disposed on the bottom (30) of the airfoil housing (15), wherein the opening (40, 45) is configured to direct air (80') over the Coanda surface (50), wherein the bottom (30) of the airfoil housing (15) further comprises a golf ball pattern (25);

a web (75) is configured to be suspended under the bottom (30) of the airfoil housing (15), and when the web (75) moves in a first direction (95) relative to the bottom (30) of the airfoil housing (15), air (80') flowing through the opening (40, 45) flows over the Coanda surface (50) in a direction perpendicular to the direction (95) of web movement.

15. The web stabilizing system according to claim 14, wherein a web (75) is suspended directly under the bottom (30) of the airfoil housing (15), the web (75) moving in a direction (95) parallel to a length (L) of the bottom (30) of the airfoil housing (15), and air (80') flows through the opening (40, 45) over the Coanda surface (50) in a direction (W) perpendicular to the direction (95) of web movement.

16. The web stabilizing system according to claim 14, wherein the opening (40) is a slot (45).

17. The web stabilizing system of claim 14, wherein the top (10) of the airfoil housing (15) further comprises sloped surfaces.

18. The web stabilizing system of claim 14, wherein the opening (40) is a series of holes.

19. The web stabilizing system according to claim 14, wherein the area defining the opening (40, 45) in the bottom (30) of the airfoil housing (15) further comprises a top ledge (57) oppositely disposed a bottom ledge (54), wherein the top ledge (57) and bottom ledge (54) define a gap (36) between the top ledge (57) and bottom ledge (54).

20. A web stabilizing system comprising:

an airfoil (1) comprising an airfoil housing (15) having a top (10) and a bottom (30);

an air inlet (20) extending into the airfoil housing (15), wherein the air inlet (20) is in fluid communication with a conduit (90) disposed inside the airfoil, wherein the conduit (90) is in fluid communication with an area of the bottom (30) of an airfoil housing (15) defining an opening (40, 45) in the bottom (30) of the airfoil housing (15);

a Coanda surface (50) disposed on the bottom (30) of the airfoil housing (15) adjacent the area defining the opening (40, 45) in the bottom (30) of the airfoil housing (15), wherein the opening (40, 45) is configured to direct air (80') over the Coanda surface (50) along the bottom (30) of the airfoil housing (15); and a web (75) suspended under the bottom (30) of the airfoil housing (15), wherein the bottom (30) of the airfoil housing (15) further comprises a golf ball pattern (25).

* * * * *